US007375632B1

(12) United States Patent
Sebanc

(10) Patent No.: US 7,375,632 B1
(45) **Date of Patent: *May 20, 2008**

(54) PROGRAMMABLE LOCATING SYSTEM AND METHOD

(75) Inventor: John Sebanc, 7323-13 E. Gainey Ranch Rd., Scottsdale, AZ (US) 85258

(73) Assignee: John Sebanc, Scottsdale, AZ (US)

( * ) Notice: Subject to any disclaimer, the term of this patent is extended or adjusted under 35 U.S.C. 154(b) by 151 days.

This patent is subject to a terminal disclaimer.

(21) Appl. No.: 11/002,367

(22) Filed: Dec. 1, 2004

Related U.S. Application Data

(63) Continuation-in-part of application No. 10/255,142, filed on Sep. 24, 2002, now Pat. No. 6,943,679, which is a continuation-in-part of application No. 09/963,843, filed on Sep. 25, 2001, now Pat. No. 6,535,120.

(51) Int. Cl.
*G08B 13/14* (2006.01)
*G08B 1/08* (2006.01)

(52) U.S. Cl. ..... 340/572.1; 340/539.11; 340/539.13; 340/825.36; 340/825.49; 340/505

(58) Field of Classification Search ..... 340/572.1, 340/572.8, 539.11, 539.13, 539.21, 825.36, 340/825.49, 505, 506, 5.25, 5.23, 825.22
See application file for complete search history.

(56) References Cited

U.S. PATENT DOCUMENTS

| | | | | |
|---|---|---|---|---|
| 4,476,469 | A | 10/1984 | Lander | |
| 5,598,143 | A | 1/1997 | Wentz | |
| 5,638,050 | A | 6/1997 | Sacca et al. | |
| 5,883,576 | A | 3/1999 | De La Huerga | |
| 5,939,981 | A * | 8/1999 | Renney | 340/539.32 |
| 6,133,832 | A * | 10/2000 | Winder et al. | 340/572.1 |
| 6,297,737 | B1 * | 10/2001 | Irvin | 340/571 |
| 6,331,817 | B1 * | 12/2001 | Goldberg | 340/573.1 |
| 6,346,886 | B1 | 2/2002 | De La Huerga | |
| 6,366,202 | B1 * | 4/2002 | Rosenthal | 340/539.32 |
| 6,462,658 | B1 * | 10/2002 | Bender | 340/568.1 |
| 6,501,378 | B1 * | 12/2002 | Knaven | 340/539.1 |
| 6,535,120 | B1 | 3/2003 | Sebanc et al. | |
| 6,563,427 | B2 | 5/2003 | Bero et al. | |
| 6,573,833 | B1 * | 6/2003 | Rosenthal | 340/539.13 |
| 6,624,752 | B2 * | 9/2003 | Klitsgaard et al. | 340/572.1 |
| 6,774,787 | B1 * | 8/2004 | Melbourne | 340/539.1 |
| 6,891,471 | B2 * | 5/2005 | Yuen et al. | 340/539.32 |
| 7,034,684 | B2 * | 4/2006 | Boman et al. | 340/568.1 |

(Continued)

*Primary Examiner*—Toan N. Pham
(74) *Attorney, Agent, or Firm*—Sawyer Law Group LLP

(57) ABSTRACT

A programmable locating method and system comprises a first electronic device having an actuator, a transceiver, and an integrated circuit. The integrated circuit is coupled to the transceiver and to the actuator. The integrated circuit is configured such that when the actuator is activated, the first electronic device transmits a first signal indicating that the first electronic device is in a program mode and identifies the actuator. One embodiment of the invention provides a locating system where the user may program the communication relationship between devices and allows one device to be assigned to a single or plurality of other devices. A single device may act as a response unit or a control unit, the response unit typically being "found" by the control unit. While acting as a response unit, the device may be "found," or may act as a control unit and find other devices acting as response units.

42 Claims, 5 Drawing Sheets

U.S. PATENT DOCUMENTS 7,064,662 B2 * 6/2006 Goggin ..... 340/539.32
7,064,663 B2 * 6/2006 Pucci et al. ..... 340/539.32
2002/0036569 A1 * 3/2002 Martin ..... 340/573.1

* cited by examiner

PROGRAMMABLE LOCATING SYSTEM AND METHOD

CROSS-REFERENCE TO RELATED APPLICATIONS

This application is a continuation-in-part of patent application Ser. No. 10/255,142, filed Sep. 24, 2002 now U.S. Pat. No. 6,943,679, which is a continuation-in-part of Ser. No. 09/963,843 filed Sep. 25, 2001 U.S. Pat. No. 6,535,120, issued Mar. 18, 2003, each incorporated by reference herein.

BACKGROUND OF THE INVENTION

1. Field of the Invention

The present invention relates to the field of detection and location devices and methodologies employing such devices, in particular, for those systems and devices which are used to detect and locate an object or objects, particularly remotely located objects whose location is unknown and sought by the user of the invention.

2. Description of Related Art

In today's world, with the individual's increasing accumulation of possessions, and the progress of science and commerce constantly creating new consumer goods, it is increasingly difficult for the individual to keep track of or manage his or her possessions. The continued reduction in size of many of consumer goods containing electrical circuitry makes it easier for the individual to misplace these possessions, with a corresponding increase in difficulty in finding said misplaced possessions. Once, the haven of the lost only belonged to misplaced or mislaid glasses, keys, wallets, gloves, or other small personal items, but now the gates have opened to encompass a multitude of sophisticated electronic devices of reduced size such as portable phones, cellular phones, hand-held computers, personal calendar/diaries, remote controls for automobiles, entertainment devices and their associated remote controls, and the like. Today's individual places great reliance on his or her electronic goods, and a temporary or permanent loss of these goods can cause great impairment to that individual and his or her ability to effectively function in today's society.

There is a need for a means by which an individual can find such misplaced or waylaid items quickly and efficiently. Much of the prior art has focused on transponder/receiver technology in which a hand-held device, large enough so that it cannot be easily lost in the first place, is activated by the individual looking for the undetectable item. Upon activation, the hand-held device would emit a signal that would be detected by a receiver attached to or incorporated into the said misplaced item prior to becoming misplaced. Upon receipt of said signal, the receiver would activate its own signal generator, such as a light or sound emitter, to alert and guide the operator to the lost device's location.

The prior art location apparatus would use ultrasound, infrared, radio frequency and the like for transmission/reception as a means to provide communication between transmitter and the receiver. The various types of circuitry employed therein are well known to those versed in the art.

The U.S. Pat. No. 5,939,981 issued to Renny, U.S. Pat. No. 4,476,469 issued to Lander and U.S. Pat. No. 5,638,050 issued to Sacaa address the use of a wireless communication system comprised of a sending unit and a responding unit wherein a button on the sending unit causes the transmission of a fixed code that will be responded to by a particular responding unit.

What has not been adequately addressed by the prior art are those systems, means and apparati which would enhance the commercial viability of the location art. The issue that needs to be addressed is how to allow full commercial realization of the genre of the location art as a whole, not the specific means of location. What is needed is a programmable locating system.

BRIEF SUMMARY OF THE INVENTION

The invention is a programmable/re-programmable locating and paging system and method, whereby one embodiment of the invention comprises a first electronic device having an actuator, a transceiver, and an integrated circuit. The integrated circuit is coupled to the transceiver and to the actuator. The integrated circuit is configured such that when the actuator is activated, the first electronic device transmits a first signal indicating that the first electronic device is in a program mode and identifies the actuator.

One embodiment of the invention also inversely allows the assignment of a response device to a specific actuator button located on a multitude of central control units. This aspect of the invention further allows a response unit, either sold as a separate item or incorporated as part of a consumer good, to be easily assigned by the consumer to a specific setting on the individual consumer's specific central control unit which may or may not be sold in conjunction with that particular response unit or that consumer good. At the same time, a response unit could be sold with a central control unit, both of which could be coordinated with other response units and central control units obtained at different times.

The invention allows the user to program the communication relationship between the central control unit and the response unit and allows a response unit to be assigned to a single or a plurality of central control units. The invention enhances the commercial viability of the location and paging arts by permitting the response or polled units built into one particular type of commercial goods to have the ability to be programmed in several different communication relations with a single central unit allowing multiple purchases by a single consumer without losing the locating ability of any one specific good. The universal capability of allowing a locator system to have a programmable/re-programmable ability to reset a communication link between a control unit and a response unit that is connected to or made a part of the item sought to be located.

The invention allows a user to purchase a device containing the response unit, that device becoming a subcomponent of another device, thus allowing the other device to acquire the location/detection/paging capability of the subcomponent. This would also allow ease of resale since the new owner could easily reprogram the response device or a resold item containing a response device to respond appropriately to the new owner's own central control device.

This universal programmable/re-programmable aspect of such location/paging systems and methods would greatly enhance the probability that manufacturers of consumer devices would utilize the invention knowing that their products would not have a single fixed response communication link, but could easily be programmed and reprogrammed indefinitely to fit that individual consumers' location protocol. Thus, the consumer could buy a multitude of the same product or a multitude of different products, without losing the ability to find any of them when they were lost.

The invention allows the central control unit and the remote unit to communicate with each other and each to have the capability to communicated with the goods of which each may have become a subcomponent or associated with. Each control unit and remote unit would have transceiving, memory, and processing capabilities.

The central unit and the remote unit have the ability to exchange data and information stored in each of their memories and to acquire, process, and exchange data and information or data which may be acquired from the object or goods with which each may be associated or have become a subcomponent of. For example, the remote unit or control unit may communicate with or be built into devices such as mobile phones, computers, or a personal digital assistant (PDA) in order to use or enhance the expanded functions or capabilities of that device.

BRIEF DESCRIPTION OF THE SEVERAL VIEWS OF THE DRAWING(S)

DETAILED DESCRIPTION OF THE INVENTION

The present invention, programmable universal locating system and method, generally denoted by numeral 1, is comprised of two apparati, the central control unit generally denoted by numeral 10, and the response unit (or remote unit) generally denoted by numeral 40.

Figure 1:
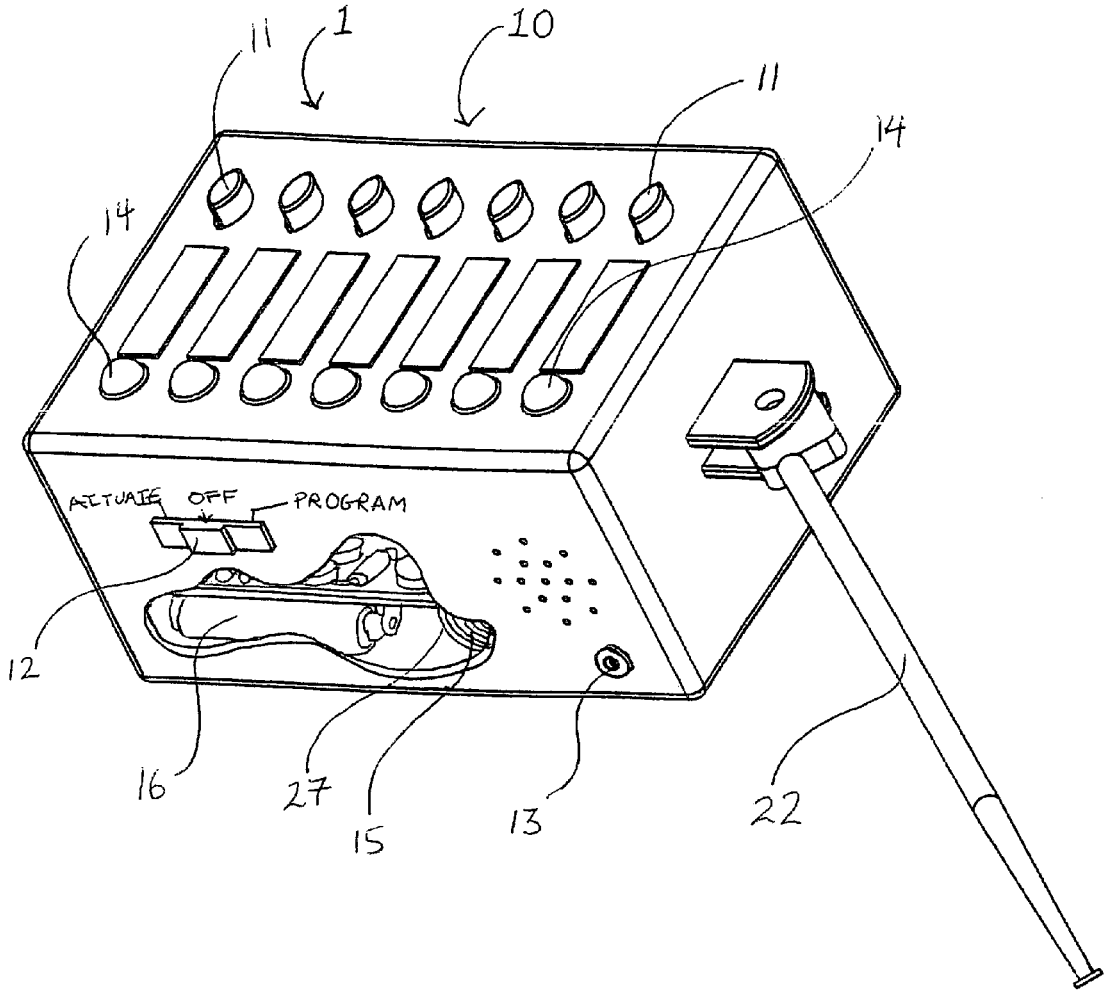
FIG. 1 depicts a partial cut-away perspective view of the central control unit.

As shown in FIG. 1, one embodiment of the central control unit 10 would be a hand-held unit with a surface featuring a plurality of actuator switches. The surface would also feature a light emitting source generally referenced as #14, such as LEDs (Light Emitting Diode) or the like, for indicating the relative distance between the central control unit and a remotely placed response unit. In another embodiment of the central control unit, in lieu of or in addition to the light-emitting source 14, a sound-emitting source, generally referenced by numeral, such as a piezo horn, and its operating circuitry, could be used as well. The operator could hear a sound-emitting device 15 through a cluster of apertures that are placed on the unit.

The surface of the unit would further support a mode selector switch 12 as well as an electrical connection jack 13 for reversibly connecting an external power supply or a external recharger to the internal power supply 16 of the central control unit 10.

The unit would encompass electronic circuitry which is connected to the power source 16, the plurality of actuator switches 11, the mode selector switch 12, the electrical connection jack 13, and the light emitting source 14 or sound emitting device 15.

In another embodiment, the physically manipulated actuator switches 11 could be replaced with voice-activated or electronically initiated switching circuitry. The actuator switch locations, or assigned digital addresses, could also be preprogrammed and stored in programmable or reprogrammable memory. The actuator positions could also be randomly chosen by the processor contained in the central control unit 10 and also the positions could be randomly assigned coded or encrypted addresses to prevent access or interference for other central control or polling units.

In another embodiment of the invention 1, the central control unit 10 can also be embodied as an integral part of another good. For example, the circuitry of the central control unit 10 could be incorporated into circuitry of a power source charging unit that is used to charge the internal power source of other goods. The power source charging unit would have the external devices of the central control unit circuitry (e.g., the plurality of actuator switches, mode selection switch, etc). In this manner, the charging unit would have all the primary capabilities of the central control unit, while the goods, which the charging unit is used for, could have the circuitry of the response unit 40. In this other embodiment, the charging unit, such as a battery charger for cell phones, would allow the operator to locate the lost or misplaced goods, such as cell phones that are recharged by their battery charger or any other remote polled unit which may be assigned to the circuitry of a central unit which may be embedded in that charger.

In another embodiment, the invention may be implemented in an electronic device, for example a cell phone, personal digital assistant (PDA), electronic tablet, and so on. Central control unit 10 may be programmed into the functionality of such a device, and the included buttons, switches, or screen of the device, for example, become actuator switches, selection switches, and so on. Actuator switches 11 include a touch sensitive screen on a PDA, for example.

In another embodiment, the invention may be implemented as part of a network, for example ZIGBEE, where the central control unit may be implemented in a software application on a device capable of executing the application (PC, server, etc.) and the actuator may be replaced by appropriate actions taken by input to the device, for example: pressing keys on a keyboard, a touchscreen, speaking into a microphone, pressing the button on a mouse, and so on.

In another embodiment, a device, for example a cell phone, may function as both a central control unit for a group of response units, and as a response unit slaved to some other control unit. For example, a PDA may be a control unit able to find a cell phone, but also a response unit to the cell phone's function as a control unit. If either is lost, then the other may be used to find the missing one.

The appearance and construction of the central control unit 10, either as a stand-alone device or as a feature that is incorporated in other goods, can vary widely since the ability to construct the device with a wide variety of "off-the-shelf" components is well known to those versed in the art.

The central control or polling unit could contain all or part of the capabilities of a totally complete central control unit depending upon the needs and uses for which that specific central control unit was designed. For example, the central control unit that may be incorporated in the base of a charger of some goods may not have a processor, a separate power source, and may only have a few pre-assigned actuator positions that may not be able to be changed. The central control unit 10 may only have basic functions in an attempt to control cost, ease manufacturing and reduce space (the same applies to the remote unit, which may contain all or part of the capabilities of a totally complete remote unit).

Figure 2:
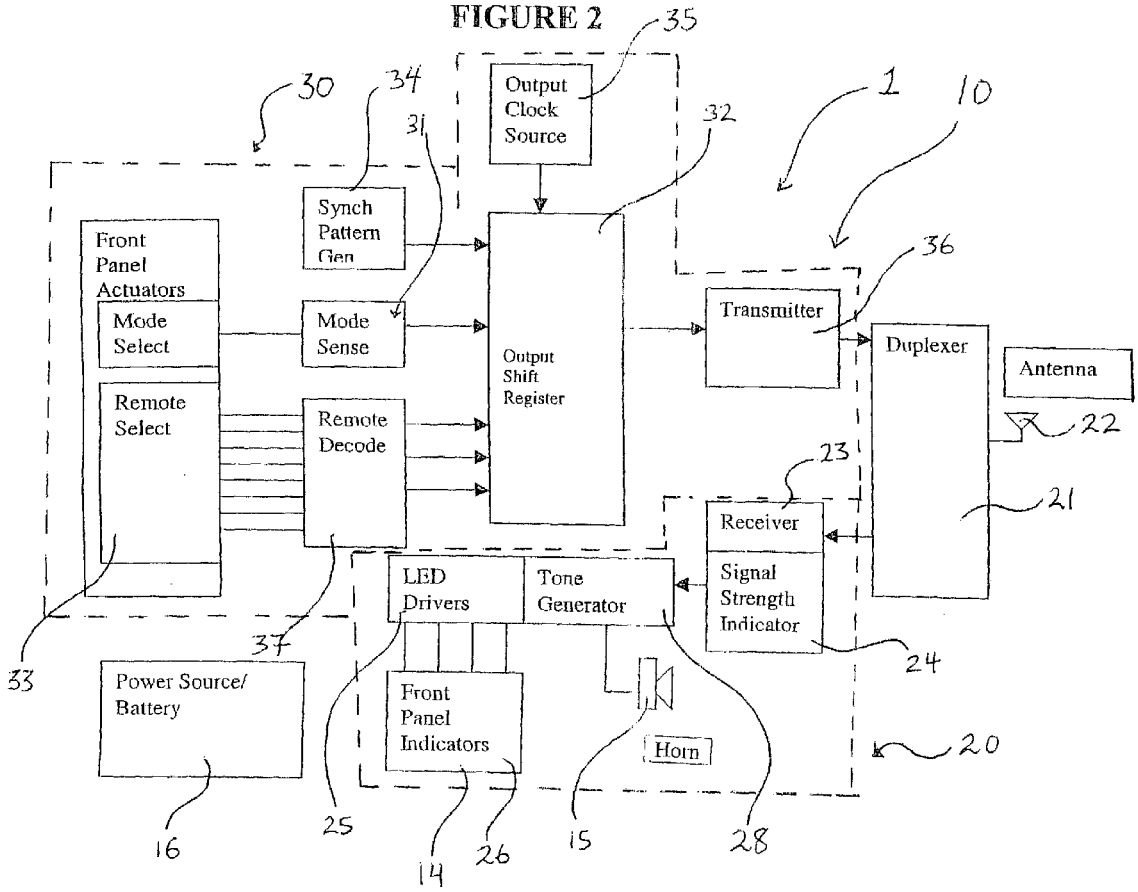
FIG. 2 depicts a block diagram of the elements of the central control unit.

As shown in FIG. 2, the block diagram of the central control unit 10, there are two basic subsystems to the central control unit 10. The first subsystem, the proximity detection unit, is generally referenced by numeral 20. The second subsystem, the universal programming system, is generally denoted by numeral 30.

The proximity detection unit 20 is comprised of a duplexer 21, a receiver 23, a signal strength indicator 24, and a light emitting 14 or sound-emitting 15 source. The duplexer 21, receives and transmits Radio Frequency ("R/F") signals ("radio waves") through its antenna 22. The duplexer 21, in filtering all the R/F signals that its antenna 22 receives, will only allow those R/F emissions which are of a certain frequency or within a certain frequency range to pass through to the receiver 23, i.e. transmissions from the response unit.

Once the R/F signal is sent to the receiver 23 by the duplexer 21, the receiver 23 transforms the R/F signal into an electrical signal. This electrical signal is passed to the signal strength indicator 24, which reads strength and intensity of the electrical signal sent to it. Based on the strength of the transformed R/F (or other wireless medium, for example BLUETOOTH and infra-red) signal, the signal strength indicator 24 sends an electronic signal to the LED drivers 25 whose circuitry powers up the light-emitting source 14 in the embodiment (LEDs) 26. The LED drivers 25, in accordance with the intensity of the electrical signal received from the signal strength indicator 24, cause the LEDs 26 to give off a visual signal corresponding in intensity to the strength of the originally received R/F signal, either through brightness, or if the LED driver 25 incorporated a strobe circuit, through altering the frequency of flashing of the LEDs to indicate to the operator the relative proximity of the central control unit 10 to the response unit 40.

In another embodiment, the signal strength indicator could also send an electrical signal to a tone generator 28 that would activate an electrical horn 27 or other sound emission device to give off an audible signal, that would also correspond in intensity to the strength of the received R/F (or wireless) signal so as to indicate to the operator the relative proximity of the central control unit 10 to the response unit 40.

In another embodiment, the signal strength indicator could be other visual or sensory displays to give an indication of the relative proximity or the response unit to the central control unit 10 and not be limited to the LEDs or auditory indicators. In this embodiment, the display could be a liquid crystal display (LCD) or other electronic or digitally stimulated sensory indicator. For example, something similar to the graduated bar indicator used by wireless phones to indicate signal strength may be used.

The second subsystem, the universal programming system 30, which provides for activation of the programming through actuator switches 11, has a mode selector switch 12 that sets the central control unit 10 for either actuating/polling or programming/assigning a selected response unit 40.

The mode selector switch 12 is connected to a mode sense unit 31, which activates the output shift register 32 for operation into programming/assigning or actuating/paging modes. When the desired mode is set by the mode sense unit 31 for synchronizing the communication link of at least one actuator switch within the plurality of actuator locations or switches 11, also identified as a remote select 33 of the central control unit 10, to at least one polled or response unit 40, the mode sense unit 31 coordinates the circuitry for the output shift register 32, the synchronize pattern generator 34, the output clock source 35 and the transmitter 36, for the accomplishment of that purpose. The activation of a selected actuator sends forth an electrical signal to the remote decoder 37 that translates the signal into binary code for transmission to the output shift register 32. The output shift register 32 assembles the signals from the synch pattern generator 34, the mode sense unit 31 and the remote decoder 37 into a serial bits stream (SBS) signal.

This SBS signal has three distinct fields containing bit information: synchronize, mode and identification. The synchronized field containing data from the synchronize pattern generator 34 is used to allow the response unit 40 upon reception to align its data collection circuit with an incoming SBS R/F signal from the central control unit 10. The mode field contains data bits from the mode sense unit that establish with the response unit 40 the desired mode of operation. The identification field contains the bit pattern generated from the electrical signal from the remote decoder 37 that is specific to a particular actuator. One skilled in the art will recognize that multiple signals may be transmitted with the same information, rather than one signal.

The output shift register 32 also incorporates a square wave signal made by the output clock source 35 that is used to time the transmission of the assembled signal. The square wave is what allows the coordination between the central control unit 10 and response unit 40. In this manner, R/F signal frequencies, which are limited in their ease of use and capacity, are not used to set the coordination between selected actuator switch and the chosen response units 40. Once the signal is fully assembled, the output shift register 32 sends the SBS electric signal to the transmitter 36 that transforms the electrical SBS signal into a SBS R/F signal. This SBS R/F signal is sent to the duplexer 21, which blocks the SBS R/F signal from being received by the proximity detection subsystem 20 and emits the SBS R/F signal through the antenna 22. In the program mode, the emitted R/F SBS signal is a low level signal so as to only program/re-program that response unit 40 which is in close proximity (e.g. adjacent to) to the operator activated central control unit 10 during the operation of the invention in the programming mode. After the response unit 40 is programmed or preprogrammed a signal is emitted from response unit 40 indicating that the programming or assigning process has been successful. Also, a signal may emit from the central control unit indicating the same.

Another embodiment of the invention includes the use of processor 57 and transceiver 59 or a combination thereof in the components of the central control unit, which would simplify construction, ease manufacturing, provide more flexibility and reduce the number of components. The processor 57 and transceiver 59 would be able to combine many of the functions of the individual components. The combination and uses of the "off the shelf" components in the construction of electronic devices is well known and not intended to be limiting. Transceiver 59 represents transmitting and/or receiving capabilities, and in other embodiments may be simply a transmitter or receiver.

After at least one response unit 40 has been programmed/reprogrammed to be activated by at least one actuator switch of at least one central control unit 10, the mode selector switch 12, an electronic or mechanical means to set central control unit 10, can then be set for actuator paging mode. In this mode, the mode sensor 31 coordinates the synchronize pattern generator 34, the output clock source 35 and the output shift register 32. The activation of the selected actuator location switch will cause the remote decoder 37 to emit a signal to the output shift register 32. The output shift register 32 will then assemble an SBS signal bearing bit information from the synchronize pattern generator 34, the mode sense unit 31 and the remote decoder 37. The SBS signal fields contain information similar to the programming signal, except the information in the mode field contains activation, not programming code, for the response unit 40 that was previously coordinated with the activated actuator switch.

The output shift register 32 then sends the electrical SBS signal through the transmitter 36, duplexer 21, and antenna 22 that converts the electrical signal into an R/F transmission. Once the remotely located or lost coordinated response unit 40 picks up the R/F signal, the response unit 40 is activated to send a R/F signal back to the central control unit 10 which translates that signal based on its received strength into another signal that could be an audible and/or visible signal that is readily understood by the operator as being a general indication of the proximate distance between the central control unit 10 and the response unit 40.

Figure 3:
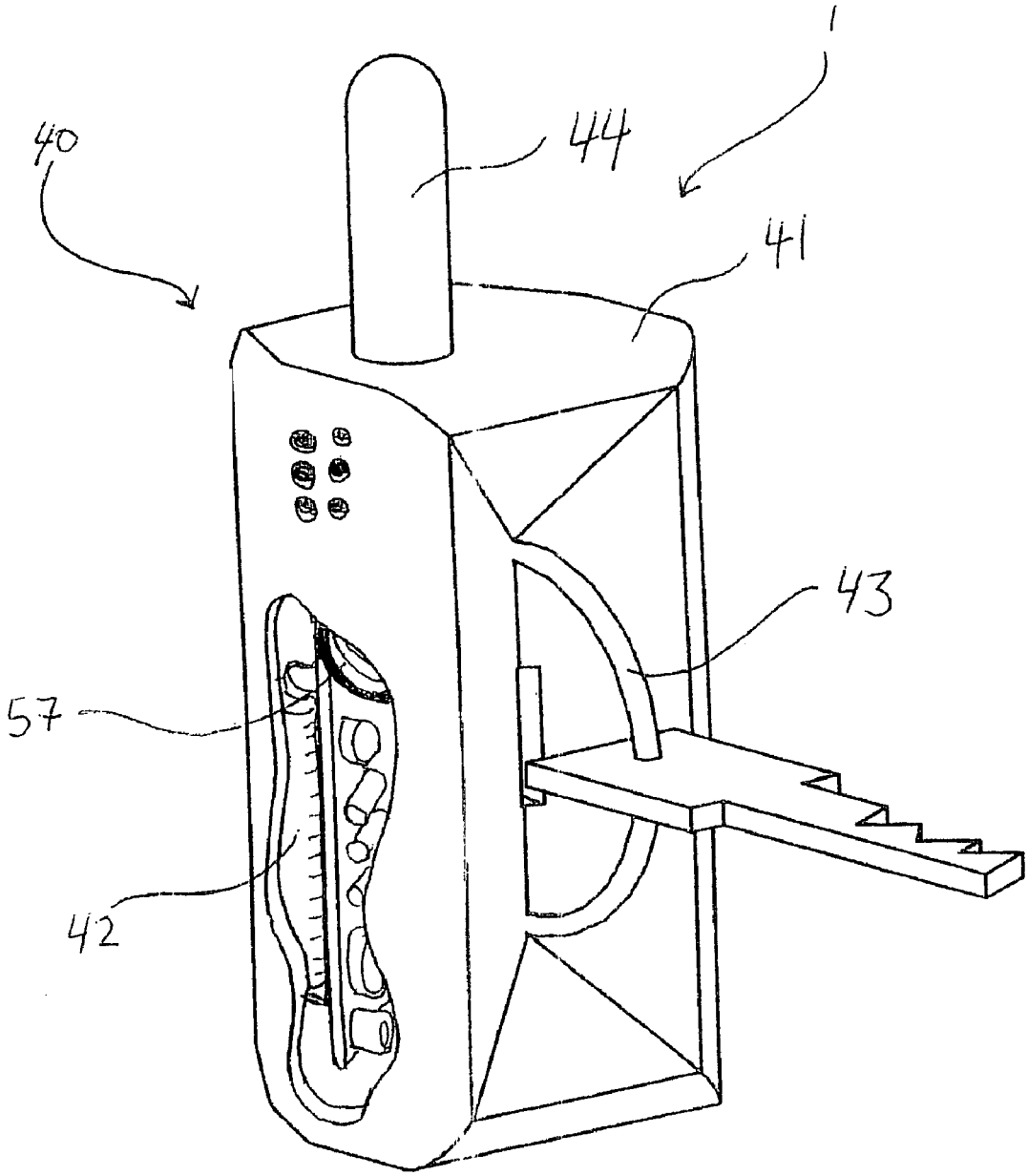
FIG. 3 depicts a partial cut-away perspective view of the response unit.

As shown in FIG. 3, the response unit 40 has a response unit body 41 that encompasses the circuitry that is connected to power source 42 also housed in the response unit body. The power source 42 can be a battery, a fuel cell, a rechargeable battery or a direct linkup to an outside power source or to the power source of the consumer good to which the response unit 40 is attached, associated with, integrated into, or any other device or system that could be used to generate power. For the attachment embodiment of the response unit 40, the response unit body can utilize several different attachment means 43 from hook and loop device, adhesives, clips, straps, case, rings and the alike.

The response unit 40 could also be incorporated as a subcomponent of another good (cell phone) as could be the central control unit 10. In this manner, the response unit 40, once integrated into the good, would afford the good all the primary location/detection/paging aspects of the invention 1. Response unit 40 could be integrated into the goods during manufacture or during post-manufacture of the good. For example, a battery pack, removable design cover or carrying case for a mobile phone could incorporate the response unit 40 to afford the location/detection/paging benefits to a mobile phone that was not originally made or designed to have such benefits. Further, the response unit could be built into a disposable power sources such as batteries or capacitors utilized by goods to confer the benefits of the invention 1 upon those goods that did not originally contain or otherwise incorporate a response unit circuitry.

Figure 4:
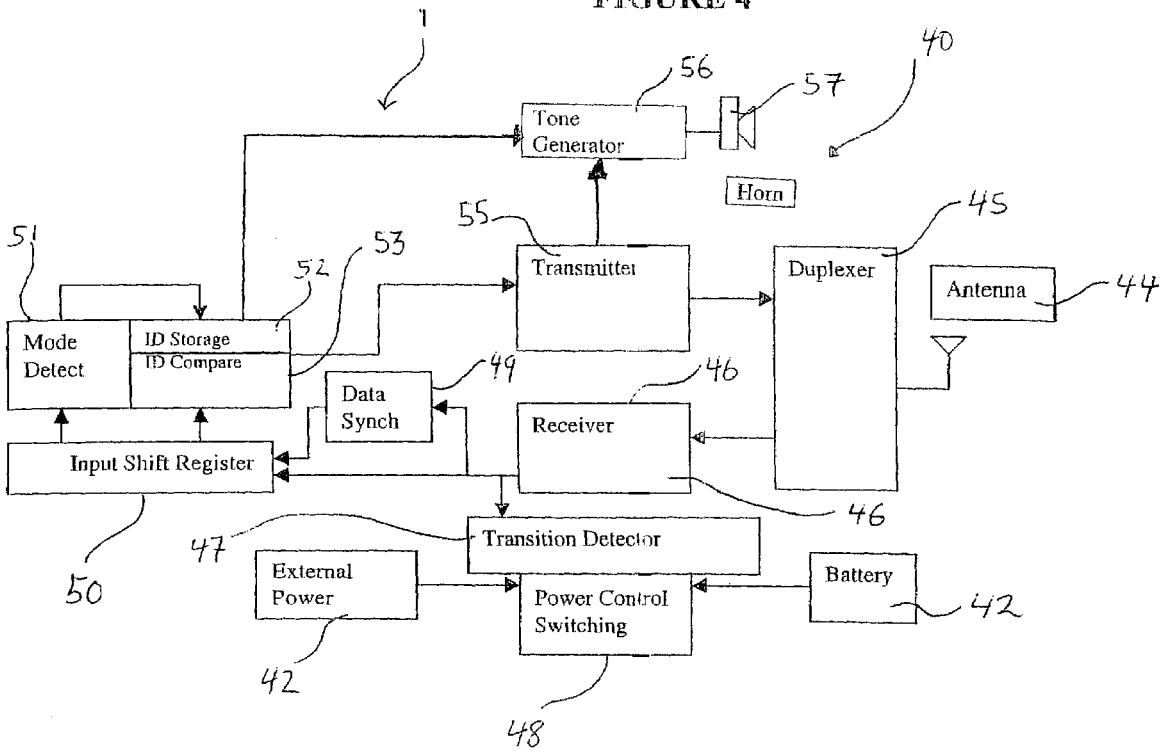
FIG. 4 depicts a block diagram of elements of the response unit.

FIG. 4 shows the block diagram of one embodiment of the response unit 40 that operates in two modes: program and locate. The incoming R/F SBS or wireless signal from one central control unit 10 is received by the antenna 44 of the response unit 40 and is conducted to the duplexer 45. If the received signal is within a certain preselected RTF frequency range, then the signal is passed to the receiver 46 that transforms the R/F signal into an electronic signal. A transition detector 47 senses the issuance of an electronic signal. The transition detector 47 activates the power control switching 48, which is connected to an external power source, such as that of the good to which the response unit 40 is attached to or otherwise incorporated into, or a battery 42. The power control switching 48 normally has the circuitry of the response unit 40 in a low power/low drain state (i.e. only the receiver and duplexer are powered to operating states). The receipt of the proper R/F signal by the response unit 40 causes the power control switching 48 to fully power up the response unit's circuitry from a low power-energy saving state.

The energy signal also activates the data synchronizer 49 whose clock issues a square wave signal into the input shift register 50. The clock of the data synchronizer 49 and that of the central control unit's output clock source 35 are synchronized as to have a corresponding square wave signal that allows the response unit to recognize the incoming signal as being from the central control unit 10. When the response unit square wave and the square wave of the incoming signal are matched in the input shift register 50, the bit data contained in the mode field of the incoming signal is sent to the mode detector 51 of the response unit 40. If the received signal is background noise or another signal that was not assembled through the use of a matching square wave, then the input shift register 50 will not process the received signal. The mode detector 51 then sends a signal to the ID storage 52 and the ID compare 53 to set them for either program or actuator functions. The input shift register 50 also sends the bit data from the identification field as a signal to the ID storage 52 and the ID compare 53. If the ID storage 52 and the ID compare 53 are set for the actuator function, the ID compare 53 compares the identification field data with identification data stored in the ID storage 52. If there is a match, a signal is sent to the transmitter 55 that sends a R/F signal out through the duplexer and antenna to the remote central control unit 10 that sent the received SBS signal in the first place. The transmitter 55 also sends a signal to the tone generator 56 that activates the horn 57. The horn gives off an audible signal to guide the operator to find the response unit 40 associated with the lost object. If there is no match, no R/F signal or audible/light signal is emitted from the response unit 40 and the response unit returns to a powered down state. The signal that would be emitted from the remote unit could be any sensory (audible, visual, tactile, etc.) or other signal that may be used to bring attention to the remote unit.

The central control unit 10, upon receipt of the R/F (or other wireless) signal from the response unit 40, as described above, produces a signal that is understandable by the operator to indicate the proximate distance between the central control unit 10 and response unit 40, and may be audible, visual, or any other sensory signal or method of conveying an understandable signal or signals to bring attention or alert the operator that the match to the remote unit has been achieved. After a predetermined time period, the transmitter will cease transmitting and the response unit 40 will return to its low power state.

If the ID storage 52 and the ID compare 53 are set for the program function, the ID storage 52 will accept the identification bit data from the incoming SBS signal and store them either for the first time in programming of the response unit or will reprogram the response unit 40 by displacing earlier stored identification bit information with new identification bit information from the received SBS signal. The ID storage 52 unit will then send an electrical signal to the tone generator 56 that activates the horn 57. The horn 57, or some other signal, gives off an audible signal to inform the operator that the response unit 40 has been programmed or reprogrammed by accepting the identification code or encrypted address.

The use of a processor 58 and a transceiver 60 or combination processor/transceiver in the components of the remote unit, which would simplify the ease of construction and manufacturing, gives more flexibility and reduces the number of components. The processor 58 and transceiver 60 or a combination would be able to combine the functions of some of the individual components. The combinations and uses of standard components in the construction of electronic devices are well known and the invention is not limited to the embodiments disclosed herein.

One aspect of the invention provides the central control unit and the response unit the capability to communicate with each other and to exchange data and information that each may acquire or have. Sharing qualities of other components, the central control unit and response unit may share either or both of their functions. Additionally, when the central control unit is programming the response unit, data is being transmitted that may allow multiple or different actions to be taken by the response unit when it receives the programming signal, for example: ringing a cell phone, turning on a PDA, etc.

Each of the central control units and response units may be incorporated into some other electronic device as a subcomponent and therefore give that device the benefit of the invention. Conversely, the response and control units may interface with some electronic device and gain benefit from the devices functionality. The remote unit and control unit may be fully integrated into another electronic device, for example a mobile phone, PDA, computer, key chain FOB, and so on, sharing a power source, or may exist separately while connected to the same power source, or have separate power sources.

Figure 5:
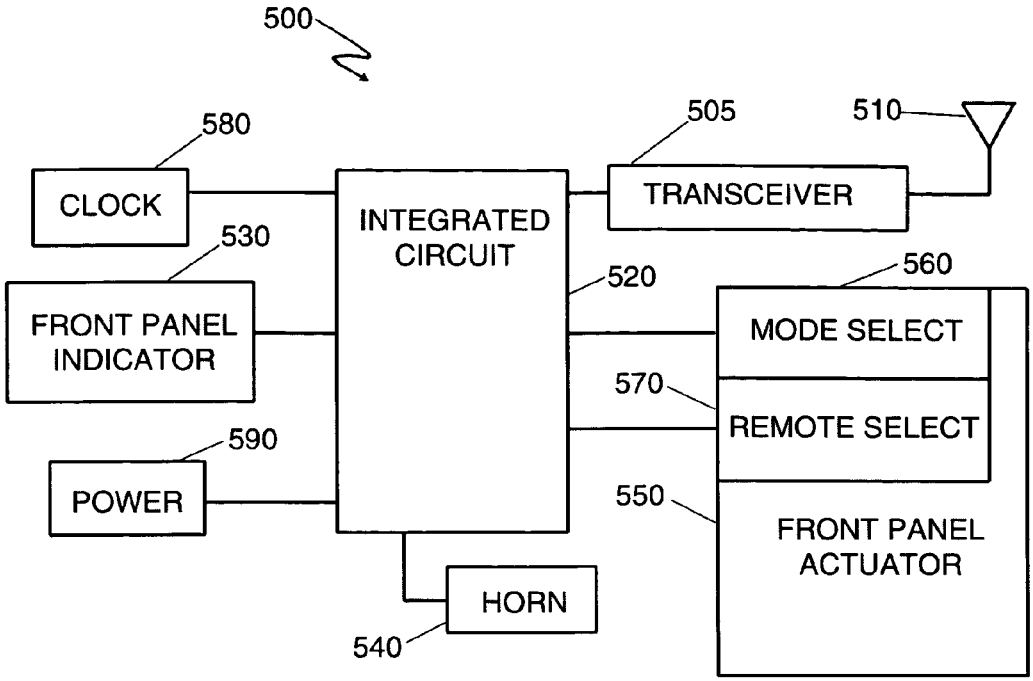
FIG. 5 illustrates a block diagram of one embodiment of the control unit.

FIG. 5 illustrates a block diagram of one embodiment of the invention. Control unit 500 has a mode selector switch that sets control unit 500 in two modes: actuate and program. In actuate mode, control unit 500 transmits a signal and then receives a signal from a response unit (see FIG. 6) and after interpreting the strength of the received signal provides a visual and/or audible cue to an operator indicating the relative proximity of the response unit. In program mode, control unit 500 associates one or more response units with a specific actuator on control unit 500.

After control unit 500 sends a signal in actuator mode, transceiver 505 receives a signal through antenna 510 from a response unit. The signal may be in R/F, infrared (IR), microwave, very low frequency (VLF), or any other transmission medium known to those skilled in the art of wireless signal transmission. Antenna 510 may be a sensor for receiving IR, RF, microwave, etc. Transceiver 505 is configured to filter out unwanted signals, for example transceiver 505 would filter R/F signals within a determined frequency range. One skilled in the art will recognize that this applies to other signal transmission mediums and will know how to achieve a desired range. Transceiver 505 may also be a component of integrated circuit 520, and may include sensors or other components as necessary for the chosen transmission medium, whether IR, RF, microwave.

Transceiver 505 transforms the received signal into an electrical signal. Transceiver 505 directs the electrical signal to integrated circuit 520, which determines the strength and intensity of the electrical signal. Integrated circuit 520 causes light sources (not shown), for example LEDs or incandescent bulbs, in front panel indicator 530 to represent the strength of the received signal. For example, a received signal that integrated circuit 520 interprets as strong may appear as a bright light, or a rapid strobe, or several lights at once, and so forth, on front panel indicator 530. Conversely, a weak signal may appear as a dim light, a slow strobe, or only one out of many light sources. The strength of the received signal indicates the relative proximity of a response unit. One skilled in the art will recognize that any combination of the above examples may be employed, as well as other visual cues.

Integrated circuit 520 may also cause horn 540 to emit sound corresponding to the strength of the received signal. For a strong signal horn 540 may emit a loud sound or rapidly repeated sounds. Conversely, for a weak signal horn 540 may emit a quiet sound or slowly repeated sounds.

Control unit 500 has a mode selector switch (shown in FIG. 1) that sets control unit 500 to either actuating or programming a response unit. Front panel actuator 550 houses mode select 560, which in one embodiment is mode select switch 12 of FIG. 1. Mode select 560 couples to integrated circuit 520 and indicates operation in either programming or activator modes.

In another embodiment, control unit 500 has actuators that are always in program mode and other actuators that are always in locate mode. Each actuator is part of a pair of program/locate actuators, whereby if one of the pair is pressed, a program signal for the pair is transmitted. When the other actuator in a pair is pressed, a locate signal is transmitted for the pair. While a minimum of two actuators are needed in this embodiment (one that always sends a program signal while the other always sends a locate signal), switching between modes is not necessary, as both modes are available, depending on which actuator is used.

While mode select 560 is in programming mode, remote select 570, which in one embodiment corresponds to actuators 11 of FIG. 1, links a specific actuator with one or more specific response units. The one or more response units are kept in close proximity to control unit 500. The specific actuator to be linked with the one or more response units is activated, and remote select 570 transmits to integrated circuit 520 the identity of the actuator. Integrated circuit 520 relates the identity of the actuator to a range within control unit 500's transmission medium, for example a frequency range within the R/F spectrum. Integrated circuit 520 instructs transceiver 505 to transmit a low level signal from antenna 510 such that only response units in close proximity to control unit 500 will receive the transmitted signal. The transmitted signal may contain similar information and operate in a similar manner to the SBS signal described above.

In one embodiment, control unit 500 transmits a weak signal that all response units in close proximity will interpret as a 'program mode' signal, which prepares each response unit in close proximity for programming. A following signal carries information identifying the actuator being associated with the one or more units. The identifying information is then stored in the response unit.

In another embodiment, control unit 500 prepares each response unit for programming and indicates a transmission range for the response unit. For example, one response unit could be programmed to respond to a signal at 200 MHz while another responds to a signal at 250 MHz. In turn, each actuator could trigger transmission in a slightly different range.

Integrated circuit 520 may use clock 580 to generate and/or synchronize signals and power source 590 may be any suitable energy source for control unit 500. One skilled in the art will recognize that many methods of associating actuators with response units are available and the above are only examples and not meant to limit or restrict which are available within the wireless arena. Various methods can be used to assign, register, program and/or tag a response unit which can be detected or recognized by a central unit. For example, the response unit may also contain an electronic tag or radio frequency identification (RFID) tag, in addition to and acting in concert with the other circuitry in the response unit. Alternatively, the response unit could be a RFID tag. If the response unit has or is a RFID tag, the tag would be detectable by and interact with the central control or base unit in order to locate the response unit. For example, the response unit's signature or identification may be detectable by the control unit, which may then assign the signature or identification to any one of its actuators or locations. Then the control unit may interact with the response unit in order to locate it. Some RFID devices are programmable, in which case they may receive and store actuator, programming/locating information in a similar manner as an integrated circuit in the previous embodiments.

Figure 6:
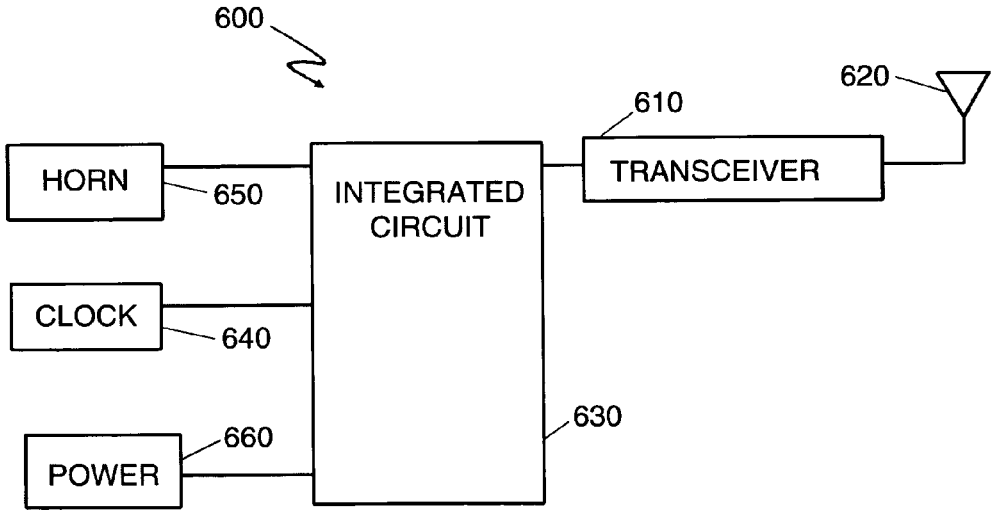
FIG. 6 illustrates a block diagram of one embodiment of the response unit.

FIG. 6 illustrates a block diagram of one embodiment of the invention. Response unit 600 operates in two modes: program and locate. In locate mode, transceiver 610 receives a signal (a locate signal) through antenna 620. Transceiver 610 transforms the received signal into an electrical signal and transfers it to integrated circuit 630.

Clock 640 may be used by integrated circuit 630 to synchronize the received signal. In one embodiment, the received signal has the SBS format outlined above. Clock 640 allows response unit 600 to recognize and synchronize the received signal. Integrated circuit 630 determines what mode the received signal indicates and then places response unit 600 in that mode. Integrated circuit 630 then determines if the identification in its memory (not shown) matches the identification in the received signal. If the signal indicates locate and there is an identification match, integrated circuit 630 instructs transceiver 610 to transmit a signal to the control unit, which will then determine the strength of the signal from response unit 600 and act according to the above description. In one embodiment integrated circuit 630 sends a signal to horn 650, causing an audible alarm. If there is no identification match then response unit 600 does nothing.

In another embodiment integrated circuit 630 has more than one identification in its memory.

If the SBS signal indicates program mode (with a program signal) then integrated circuit 520 takes ID information from the SBS signal and stores it in memory (not shown).

In another embodiment, response unit 600 is programmed to respond to a certain range within the transmission medium, for example to a certain range in RTF.

In another embodiment, programming between a response unit and the control unit may be through a wired connection, for example a link between a charger and a cell phone or PDA, or the docking station of a PDA, or a simple wire between a response and control unit, the connection for at least in part identifying an actuator on the control unit to the response unit. A wired connection may be used to accomplish other functions, for example, charging batteries in the response unit or creating a link to a device without wireless capabilities (e.g. some personal computers).

The advantages of the invention include flexibility by allowing an item to be located and unlimited reassignment of a response unit to any control unit, or groups of control units, and to any of its actuators, affordability by implementing integrated circuits, saving time and money searching for and replacing lost items, easily packaged or implemented in existing devices, use in multiple markets, whether commercial, industrial, retail, home, research, etc., and customizable with different displays possible (digital displays on liquid crystal displays (LCDs) with possible GPS interface showing precisely where the item is with respect to the user's present position).

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A programmable locating system comprising:

a first electronic device comprising:

an actuator;

a transceiver; and an integrated circuit coupled to the transceiver and to the actuator and configured such that when the actuator is activated, the first electronic device transmits a first signal indicating that the first electronic device is in a program mode and identifying the actuator, wherein when the first electronic device is in the program mode, the first electronic device programs at least one other device.

2. The programmable locating system of claim 1, the first electronic device further configured to receive a second signal from a second electronic device having an actuator, the first electronic device configured to store the identity of the actuator of the second electronic device.

3. The programmable locating system of claim 2, the first electronic device further configured to receive a third signal from a third electronic device having an actuator, the first electronic device storing the identity of the actuator of the third electronic device.

4. The programmable locating system of claim 3, the first electronic device configured to replace the identity of the actuator of the second electronic device with the identity of the actuator of the third electronic device.

5. The programmable locating system of claim 2, the first electronic device further configured to receive a third signal indicating the identity of the actuator of the second electronic device and a locate mode, the first electronic device configured to respond by transmitting a third signal for locating the first electronic device.

6. The programmable locating system of claim 5, the second electronic device further comprising a signal strength indicator coupled to the actuator and configured to emit a fourth signal with an intensity corresponding to the received strength of the third signal.

7. The programmable locating system of claim 2, the first electronic device further configured to transmit a third signal indicating the identity of the actuator of the first electronic device and a locate mode.

8. The programmable locating system of claim 2 further comprising:

a radio frequency identification (RFID) tag coupled to the integrated circuit, the RFID tag configured to receive the second signal from the second electronic device.

9. The programmable locating system of claim 1, the first electronic device configured to transmit a second signal indicating the identity of the actuator and a locate mode.

10. The programmable locating system of claim 1 wherein the first electronic device is a mobile phone.

11. The programmable locating system of claim 1 wherein the first electronic device is a personal digital assistant (PDA).

12. A method of locating comprising:

activating an actuator in a first electronic device;

transmitting a first signal indicating the first electronic device is in a program mode and identifying the actuator; and utilizing the first electronic device to program at least one other device when the first electronic device is in the program mode.

13. The method of claim 12 further comprising:

receiving a second signal indicating the program mode, wherein the second signal is from a second electronic device having an actuator, the second signal identifying the actuator of the second electronic device; and storing the identity of the actuator of the second electronic device.

14. The method of claim 13 further comprising:

receiving a third signal from a third electronic device having an actuator, the third signal indicating the program mode and identifying the actuator of the third electronic device; and storing the identity of the actuator of the third electronic device.

15. The method of claim 14 further comprising:

replacing the identity of the actuator of the second electronic device with the identity of the actuator of the third electronic device.

16. The method of claim 13 further comprising:

receiving a third signal indicating the identity of the actuator of the second electronic device and a locate mode;

transmitting a third signal for locating the first electronic device in response to the third signal.

17. The method of claim 13 further comprising:

transmitting a third signal indicating the identity of the actuator of the first electronic device and a locate mode.

18. The method of claim 12 further comprising:

transmitting a second signal indicating the identity of the actuator and a locate mode.

19. The method of claim 12 wherein the first electronic device is a mobile phone.

20. The method of claim 12 wherein the first electronic device is a personal digital assistant (PDA).

21. A programmable locating system comprising:

a first electronic device comprising:

an actuator;

a transceiver; and an integrated circuit coupled to the transceiver and to the actuator and configured to receive a first signal from a second electronic device having an actuator, the first electronic device configured to store the identity of the actuator of the second electronic device wherein when the first electronic device is in the program mode, the first electronic device programs at least one other device.

22. The programmable locating system of claim 21, the first electronic device further configured to receive a third signal from a third electronic device having an actuator, the first electronic device configured to store the identity of the actuator of the third device.

23. The programmable locating system of claim 22, the first electronic device configured to replace the identity of the actuator of the second electronic device with the identity of the actuator of the third electronic device.

24. The programmable locating system of claim 21, the first electronic device further configured to receive a second signal with the identity of the actuator of the second electronic device, the first electronic device in a locate mode and configured to respond by transmitting a third signal for locating the first electronic device.

25. The programmable locating system of claim 24, the second electronic device further comprising a signal strength indicator coupled to the actuator and configured to emit a fourth signal with an intensity corresponding to the received strength of the third signal.

26. The programmable locating system of claim 21 wherein the first electronic device is a mobile phone.

27. The programmable locating system of claim 21 wherein the first electronic devices is a personal digital assistant (PDA).

28. The programmable locating system of claim 21 further comprising:

a radio frequency identification (RFID) tag coupled to the integrated circuit, the RFID tag configured to receive the second signal from the second electronic device.

29. A method of locating a first electronic device comprising:

receiving a first signal from a second electronic device having an actuator, the first signal indicating that the second electronic device is in a program mode and identifying the actuator of the second electronic device;

storing the identity of the actuator of the second electronic device; and utilizing the second electronic device to program at least one other device when the second electronic device is in a program mode.

30. The method of claim 29 further comprising:

receiving a second signal from a third electronic device having an actuator, the second signal identifying the actuator of the third electronic device; and storing the identify of the actuator of the third electronic device.

31. The method of claim 30 further comprising:

replacing the identity of the actuator of the second electronic device with the identity of the actuator of the third electronic device.

32. The method of claim 29 further comprising:

receiving a second signal indicating the identity of the actuator of the second electronic device; and transmitting a third signal for locating the first electronic device in response to the second signal.

33. The method of claim 29 wherein the first electronic device is a mobile phone.

34. The method of claim 29 wherein the first electronic device is a personal digital assistant (PDA).

35. A response unit comprising:

a radio frequency identification (RFID) tag configured to receive a first signal from a control unit locating device, the first signal indicating a program mode and identifying a first actuator, the RFID tag configured to store the identity of the first actuator and wherein when the control unit locating device is in the program mode, the control unit locating device programs at least one other device.

36. The response unit of claim 35 wherein the response unit is configured to receive a second signal from the control unit locating device, the second signal indicating a program mode and identifying a second actuator, the RFID tag storing the identity of the second actuator.

37. The response unit of claim 36 wherein the stored identity of the second actuator replaces the stored identity of the first actuator.

38. The response unit of claim 36 wherein the RFID tag stores the identity of the second actuator in addition to the stored identity of the first actuator.

39. The response unit of claim 36 wherein the response unit is configured to receive a third signal from the control unit locating device, the third signal indicating a locate mode and identifying a first actuator, the response unit responding by transmitting a fourth signal if the identity of the first actuator was received by the response unit during a program mode and the identity of the first actuator is stored in the response unit.

40. A locating system comprising:

a control unit configured with a program mode and a locate mode, the control unit comprising:

a first integrated circuit;

a transceiver coupled to the first integrated circuit; and a first actuator coupled to the integrated circuit and configured such that when the control unit is in the program mode and the first actuator is activated, the control unit is configured to transmit a first signal and to receive a first signature from a first electronic device, the control unit configured to store and associate the first signature with the first actuator and wherein when the control unit is in the program mode, the control unit programs at least one other device.

41. The control unit of claim 40 further comprising:

a second actuator coupled to the first integrated circuit and configured such that when the control unit is in program mode and the second actuator is activated, the control unit is configured to transmit a second signal indicating that the control unit is in program mode and identifying the second actuator, the control unit is configured to receive a second signature from a second electronic device and to store and associate the second signature with the second actuator.

42. The control unit of claim 40 further comprising:

a second actuator coupled to the first integrated circuit and configured such that when the control unit is in program mode and the second actuator is activated, the control unit is configured to transmit a second signal indicating that the control unit is in program mode and identifying the second actuator, the control unit is configured to receive the first signature from the second electronic device and to store and associate the first signature with the second actuator.

* * * * *